US009903609B2

(12) United States Patent
Zanqueta et al.

(10) Patent No.: US 9,903,609 B2
(45) Date of Patent: Feb. 27, 2018

(54) AIR-CONDITIONING APPARATUS PROVIDED WITH A VACUUM CHAMBER

(71) Applicant: Electrolux Do Brasil S. A., Curitiba (BR)

(72) Inventors: Hugo Flavio Benassi Zanqueta, Curitiba (BR); Danilo Toshio Fusano, Curitiba (BR); Luiz Carlos Pazinato, Curitiba (BR)

(73) Assignee: Electrolux do Brasil S. A., Curitiba (BR)

( * ) Notice: Subject to any disclaimer, the term of this patent is extended or adjusted under 35 U.S.C. 154(b) by 764 days.

(21) Appl. No.: 14/385,226

(22) PCT Filed: Mar. 15, 2013

(86) PCT No.: PCT/BR2013/000083

§ 371 (c)(1),
(2) Date: May 7, 2015

(87) PCT Pub. No.: WO2013/134842

PCT Pub. Date: Sep. 19, 2013

(65) Prior Publication Data

US 2015/0253034 A1 Sep. 10, 2015

(30) Foreign Application Priority Data

Mar. 15, 2012 (BR) ..... 102012005847

(51) Int. Cl.
*F24F 13/24* (2006.01)
*F24F 1/02* (2011.01)
*F24F 11/00* (2018.01)

(52) U.S. Cl.
CPC ..... *F24F 13/24* (2013.01); *F24F 1/022* (2013.01); *F24F 1/027* (2013.01);
(Continued)

(58) Field of Classification Search
CPC .... F24F 13/20; F24F 13/24; F24F 1/02; F24F 1/27
(Continued)

(56) References Cited

U.S. PATENT DOCUMENTS 4,448,041 A * 5/1984 Southworth, Jr. ..... B60P 3/20 62/239
6,134,904 A 10/2000 Jianxing
(Continued)

FOREIGN PATENT DOCUMENTS

CN 101251280 A 8/2008
GB 2149085 6/1985

OTHER PUBLICATIONS

International Search Report for PCT/BR2013/000083, dated Jul. 9, 2013, 2 pages.

*Primary Examiner* — Jason D Mitchell
(74) *Attorney, Agent, or Firm* — Pearne & Gordon LLP

(57) ABSTRACT

An air-conditioning apparatus (1) of the window type that transmits a reduced noise level to a closed environment and, additionally, minimizes/reduces the exchange of heat between its cold and hot parts. The air-conditioning apparatus (1) is endowed with at least a first portion (2) including at least an evaporator. Additionally, the air-conditioning apparatus (1) is endowed with at least a second portion (3) including at least a condenser and a compressor operatively associated to the evaporator. Additionally, the air-conditioning apparatus (1) is endowed with at least a vacuum chamber (4) positioned between the first portion (2) and the second portion (3).

11 Claims, 4 Drawing Sheets

(52) U.S. Cl.
CPC ..... *F24F 11/0086* (2013.01); *F24F 2011/009* (2013.01); *F24F 2013/247* (2013.01)

(58) Field of Classification Search
USPC ..... 700/276, 280
See application file for complete search history.

(56) References Cited

U.S. PATENT DOCUMENTS

| | | | | |
|---|---|---|---|---|
| 6,168,698 | B1 * | 1/2001 | Szczyrbowski | C23C 14/568 204/192.12 |
| 6,216,482 | B1 | 4/2001 | Xiao et al. | |
| 7,968,160 | B2 * | 6/2011 | Yeganeh | E04B 1/803 206/423 |
| 2003/0087598 | A1 * | 5/2003 | Adams | F24F 13/24 454/254 |
| 2003/0166757 | A1 * | 9/2003 | Nishihara | C08K 9/04 524/430 |
| 2005/0226772 | A1 * | 10/2005 | Ririe | B01L 3/502 422/68.1 |
| 2007/0187076 | A1 | 8/2007 | Martinus et al. | |

* cited by examiner

AIR-CONDITIONING APPARATUS PROVIDED WITH A VACUUM CHAMBER

FIELD OF THE INVENTION

The invention refers to an air-conditioning apparatus for treating air in enclosed environments and, more specifically, the invention refers to an air-conditioning apparatus of the window type that transmits a reduced noise level to an enclosed environment and, additionally, minimizes/reduces the exchange of heat between its cold and hot parts or regions.

BACKGROUND OF THE INVENTION

The concept of air-conditioning originated from the need to meet a demand for climatically-controlled environments by the graphics, textile, pharmaceutical and cellulose (paper) industries, in which production was adversely affected primarily due to the undesirable conditions of humidity and temperature of the environment, which directly influenced the working of the equipment and processes used.

Initially, air-conditioning was done by means of ducts and large-scale equipment, capable of cooling and withdrawing the humidity from the air and allowing its circulation in an enclosed environment. Subsequently, smaller-scale air-conditioners were developed, whereby enabling their use in homes and business establishments.

Today, air-conditioning apparatuses are relatively compact, and can be installed even in environments with reduced space. Because of this, their use has become quite widespread, principally in hot regions, and the air-conditioners of the window type have become quite popular due to their relatively low cost.

Such air-conditioners of the window type consist of apparatuses endowed with a single cabinet that comprises all the parts and components needed for cooling and/or heating air. These apparatuses are easily installed by coupling to windows or openings made in the wall (direct coupling or by means of a pre-fabricated encasement module), one part being in contact with the internal environment (enclosed) of a place and the other part in contact with the external environment (open) to the place.

However, air-conditioners of the window type present certain drawbacks such as high noise level coming mainly from the vibrations of its internal components, such as compressors and ventilators/blowers. These undesirable vibrations are transmitted from the apparatus to the internal environment and, potentially, also to a wall or structure where it is installed, increasing noise pollution and causing major nuisance and discomfort to the occupants of this internal environment.

Additionally, another problem noted in the air-conditioners of the window type consists in the energy loss resulting from the proximity between the evaporator and condenser. This proximity favors an undesirable exchange of heat between the cold and hot parts of the air-conditioner, which provides low operating performance and/or reduction in energy efficiency.

Thus, although the air-conditioning apparatuses of the state of the art meet functional demands and needs, they still present a high level of noise emission owing to the transmission of the vibrations generated by their internal components to the internal environment and, additionally, they present low energy efficiency/performance due to the exchange of heat between their cold and hot parts.

DESCRIPTION OF THE INVENTION

Therefore, an objective of the present invention is to provide an air-conditioning apparatus for treating air of enclosed environments, which is capable of reducing or eliminating the limitations of the technologies known in the state of the art.

Additionally, it is also an objective of the present invention to provide an air-conditioning apparatus of the window type capable of transmitting a reduced (lower) noise level to the internal environment where said apparatus is installed, in relation to the levels of noise transmitted by the apparatuses known in the state of the art, so as to provide greater acoustic comfort to the occupants of this environment.

Additionally, an objective of the present invention consists of providing an air-conditioning apparatus of the window type capable of minimizing/reducing the undesirable exchange of heat between the cold and hot parts of the air-conditioner.

Further, an objective of the present invention consists of providing an air-conditioning apparatus of the window type, particularly for residential or commercial application, that is silent and presents enhanced performance/energy efficiency in comparison with air-conditioning apparatuses of the state of the art.

One or more objectives of the present invention mentioned above, among others, is(are) achieved through an air-conditioning apparatus endowed with at least a first portion comprising at least an evaporator; and a second portion comprising at least a condenser and a compressor operatively associated to said evaporator. Additionally, the air-conditioning apparatus is endowed with at least a vacuum chamber positioned between the first portion and the second portion.

According to additional or alternative embodiments of the invention, the following characteristics, alone or in combination, may also be comprised:

- a cabinet externally envelops the first portion and the second portion, has a total cross-section area equivalent to the total area of the cross-section of the vacuum chamber;
- said cabinet being endowed with a first encasement that comprises the first portion; a second encasement, which comprises a second portion, associated to the first encasement; and an intermediary compartment, disposed between the first encasement and the second encasement;
- the intermediary compartment of the cabinet comprises supports, positioned perpendicularly to a base of the cabinet;
- the conditioner comprises a plurality of vacuum chambers, and the sum of the areas of the cross-sections of said plurality of vacuum chambers corresponds to the total area of the cross-section of the cabinet;
- the intermediary compartment of the cabinet comprises fins, which extend perpendicularly from at least one support;
- the first portion and/or a second portion comprise at least a ventilator/blower;
- the cabinet has the shape of an internally hollow rectangular prism;
- the vacuum chamber comprises at least a communication tube endowed capable of allowing the withdrawal of matter from inside the vacuum chamber;
- the first portion is disposed internally of a wall or window where the apparatus is installed, the second portion is disposed externally to said wall or window;
- the vacuum chamber is made of polymer material; and
- the air-conditioning apparatus is of the window type.

BRIEF DESCRIPTION OF THE DRAWINGS

The objectives, technical effects and advantages of the invention will be apparent to persons skilled in the art from the detailed description below which makes reference to the accompanying drawings, which illustrate exemplary but not limitative embodiments of the present invention, wherein.

DESCRIPTION OF EMBODIMENTS OF THE INVENTION

Initially, it is important to emphasize that the air-conditioning apparatus 1, object of the present invention, will now be described according to particular but not limitative embodiments, since their embodiments may be carried out in different ways and variations and in accordance with the application desired.

Particularly, but not compulsorily, the air-conditioning apparatus 1 is of the window type, for installing in households or business establishments. Alternatively, the air-conditioning apparatus 1 may be used in an industrial application.

According to FIGS. 1, 3, 4 and 7, the air-conditioning apparatus 1 comprises at least a cabinet 5 arranged to accommodate internal components of the apparatus 1. Said internal components consist of, for example, compressor, condenser, evaporator, expansion valve, thermostat, ventilator/blower etc., which are associated to each other by means of ducts, so as to make up a cooling or heating system. Electrical and electronic circuits and systems associated to the internal components may also be present if the air-conditioning apparatus is controlled by electronic means. Particularly, the cabinet 5 has the shape of an internally hollow prism or rectangular box. Naturally, other formats and designs of the cabinet 5 can be used.

Figure 1:
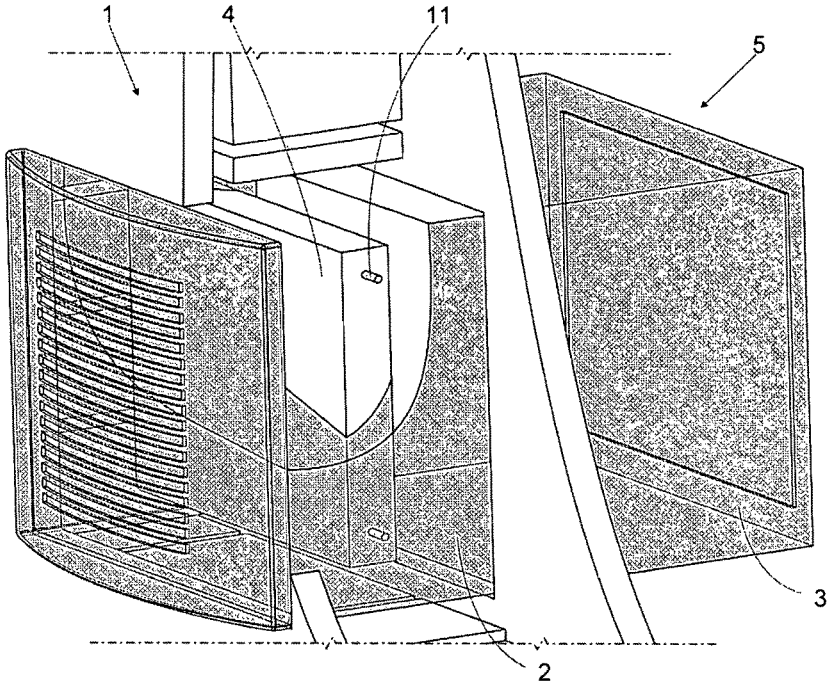
FIG. 1 illustrates a perspective view of an air-conditioning apparatus installed in a wall, according to a first particular embodiment of the present invention.
Figure 3:
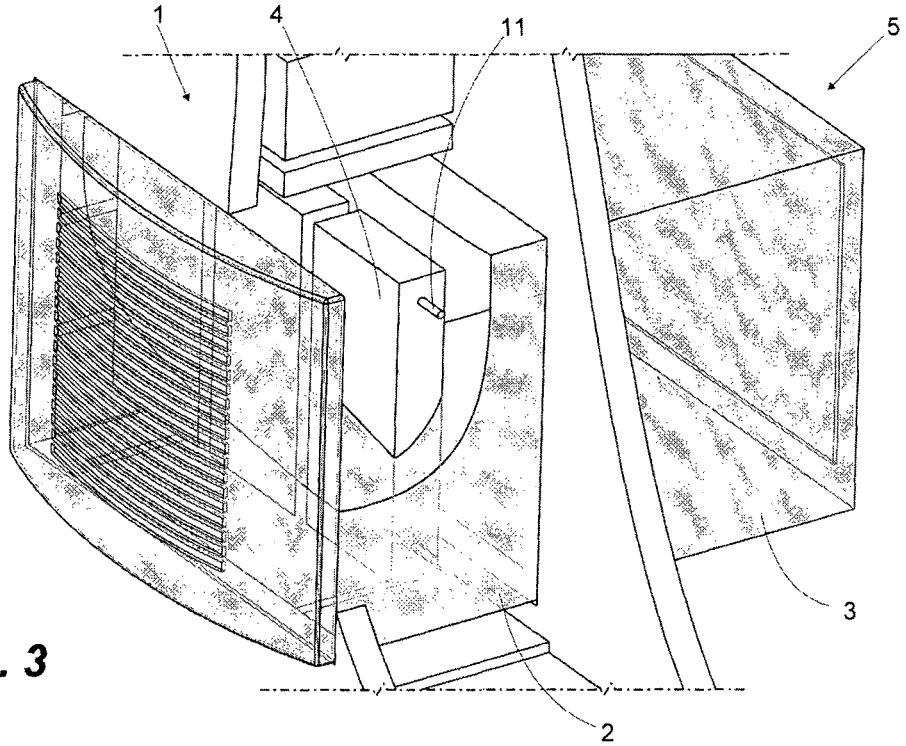
FIG. 3 illustrates a perspective view of an air-conditioning apparatus installed on a wall, according to a third particular embodiment of the present invention.

The cabinet 5 externally envelops a first portion 2 of the air-conditioning apparatus 1, as can be seen in FIGS. 1 and 3. This first portion 2 comprises at least an evaporator and preferably a ventilator or blower, and other components, which form the "cold" part/region of the air-conditioning apparatus 1, when in cooling operation mode. Normally, the first portion 2 faces towards an internal environment (enclosed) of a place. The internal portion 2 may also comprise mechanical commands or electric and/or electronic control circuits, such as control of ventilator speed, temperature and ventilation, cooling or heating.

Additionally, the cabinet 5 externally comprises a second portion 3 of the air-conditioning apparatus 1, as can be seen in FIGS. 1, 3, 4 and 7. This second portion 3 comprises at least a condenser, a compressor and, preferably, a ventilator and also other components operatively associated to said evaporator. A second portion corresponds to the "hot" part/region of the air-conditioning apparatus 1, when in cooling operation mode. Normally, the second portion 3 faces towards an external (open) environment to the place.

Thus, in accordance with FIGS. 1 and 3, the first portion 2 is particularly disposed internally to a wall or window where the apparatus 1 is installed. Moreover, the second portion 3 is generally disposed externally to said wall or window.

Figure 4:
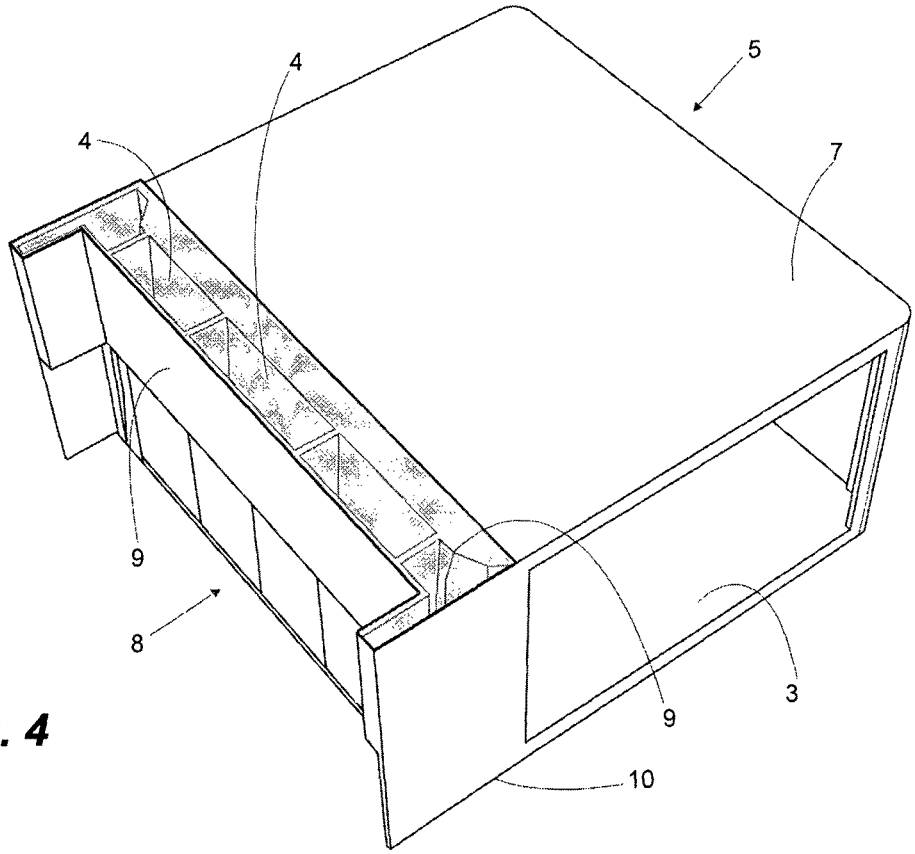
FIG. 4 illustrates a partial perspective view of a cabinet of an air-conditioning apparatus according to a fourth particular embodiment of the present invention.

Further, according to FIGS. 1, 3 and 4, the air-conditioning apparatus 1 is endowed with at least a vacuum chamber 4 positioned between the first portion 2 and the second portion 3. This vacuum chamber 4 acts as an acoustic and thermal barrier, so as to prevent or reduce, at least partially, the transmission of sound/noise and exchange of heat between the first portion 2 and the second portion 3. In other words, improved acoustic/sound insulation is obtained between the external and internal environments of a place where the apparatus 1 is installed, such that the transmission of noise and heat from the external environment to the internal environment, through the apparatus 1, is minimized/reduced, at least partially.

Accordingly, the vacuum chamber 4 allows a reduced (inferior) noise level is transmitted to the internal environment where the apparatus 1 is installed, in relation to the noise levels transmitted by the apparatuses known in the state of the art, so as to provide greater acoustic comfort to the occupants of this environment. Additionally, the vacuum chamber 4 avoids, at least partially, the exchange of undesirable heat between the cold and hot parts of the apparatus 1. Therefore, the vacuum chamber 4 of the invention provides, advantageously, an air-conditioning apparatus 1 which is silent and, simultaneously, presents improved performance/energy efficiency in comparison to the air-conditioning apparatuses of the state of the art.

As can be seen in FIGS. 1, 2, 3, 5 and 6, the vacuum chamber 4 may comprise at least a communication tube 11 endowed with a valve capable of allowing the withdrawal of matter (e.g. air) from inside the vacuum chamber 4 by means of a specific device/apparatus, such as, for example, an aspiration/suction pump. It is worth noting that the particular arrangements shown in these drawings use two communication tubes 11. Naturally, the number of communication tubes 11 may vary in accordance with the application desired.

Particularly, the total area of the cross-section of the vacuum chamber 4 is equivalent to the total area of the cross-section of the cabinet 5, that is, the area covered by the vacuum chamber 4 extends up to the ends of the cabinet 5 (four sides of the rectangular box), which provides optimal efficiency of insulation/blockage of noise transmission and exchange of heat between the first portion 2 and the second portion 3.

In a first particular embodiment of the invention, illustrated in FIG. 1, the air-conditioning apparatus 1 comprises a single vacuum chamber 4 endowed with a first communication tube 11 in its upper part and a second communication tube 11 in its lower part, and these two communication tubes 11 are disposed parallel to each other.

Figure 2:
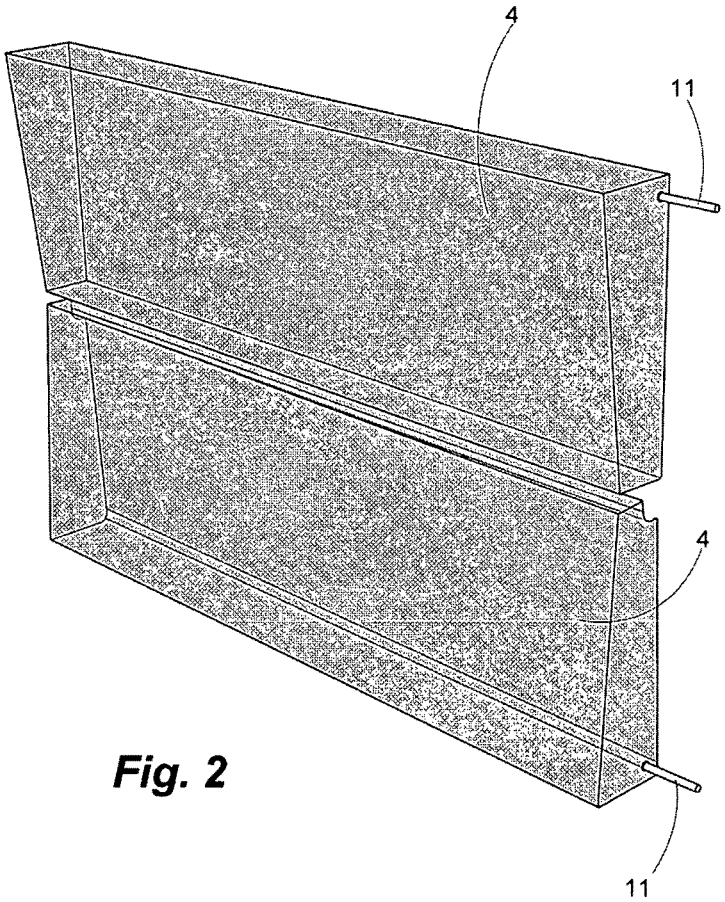
FIG. 2 illustrates a perspective view of a vacuum chamber of an air-conditioning apparatus according to a second particular embodiment of the present invention.

In a second particular embodiment of the invention, illustrated in FIG. 2, the air-conditioning apparatus 1 comprises two vacuum chambers 4, namely, an upper vacuum chamber and a lower vacuum chamber, and each of these vacuum chambers 4 comprises a communication tube 11. Again, the two communication tubes 11 are disposed parallel to each other.

In a third particular embodiment of the invention, illustrated in FIG. 3, the air-conditioning apparatus 1 comprises three vacuum chambers 4, namely, two side vacuum chambers and a central one. In this case, the three vacuum chambers 4 are associated to two common communication tubes 11, also disposed parallel to each other.

Thus, the air-conditioning apparatus 1 may comprise a plurality of vacuum chambers 4, and, preferably, the sum of the cross-sectional areas of the vacuum chambers 4 corresponds to the total area of the cross-section of the cabinet 5.

In a fourth particular embodiment of the invention, illustrated in FIG. 4, the cabinet 5 is endowed with a first encasement (not shown) which comprises the first portion 2. Additionally, the cabinet 5 is endowed with a second encasement 7, associated to the first encasement, which comprises a second portion 3. Additionally, the cabinet 5 is endowed with an intermediary compartment 8, disposed between the first encasement and the second encasement 7, and one of more vacuum chambers can be formed 4. Said intermediary compartment 8 may comprise supports 9 capable of sustaining the(s) vacuum chamber(s) 4, positioned perpendicularly at a base 10 of the cabinet 5.

Figure 5:
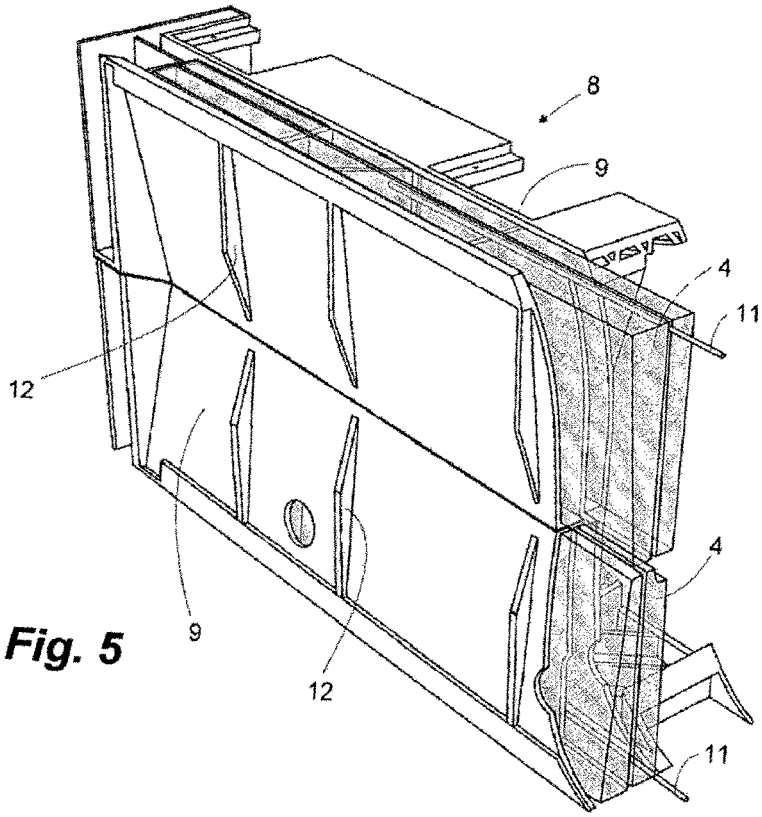
FIG. 5 illustrates a perspective (front) view of an intermediary compartment of a cabinet of an air-conditioning apparatus according to a fifth particular embodiment of the present invention.
Figure 6:
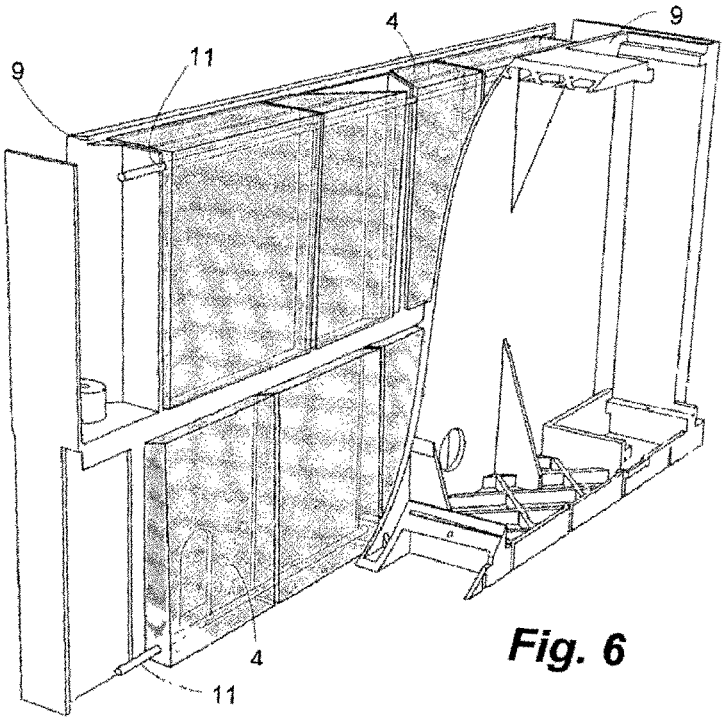
FIG. 6 illustrates a perspective (rear) view of the intermediary compartment shown in FIG. 5.
Figure 7:
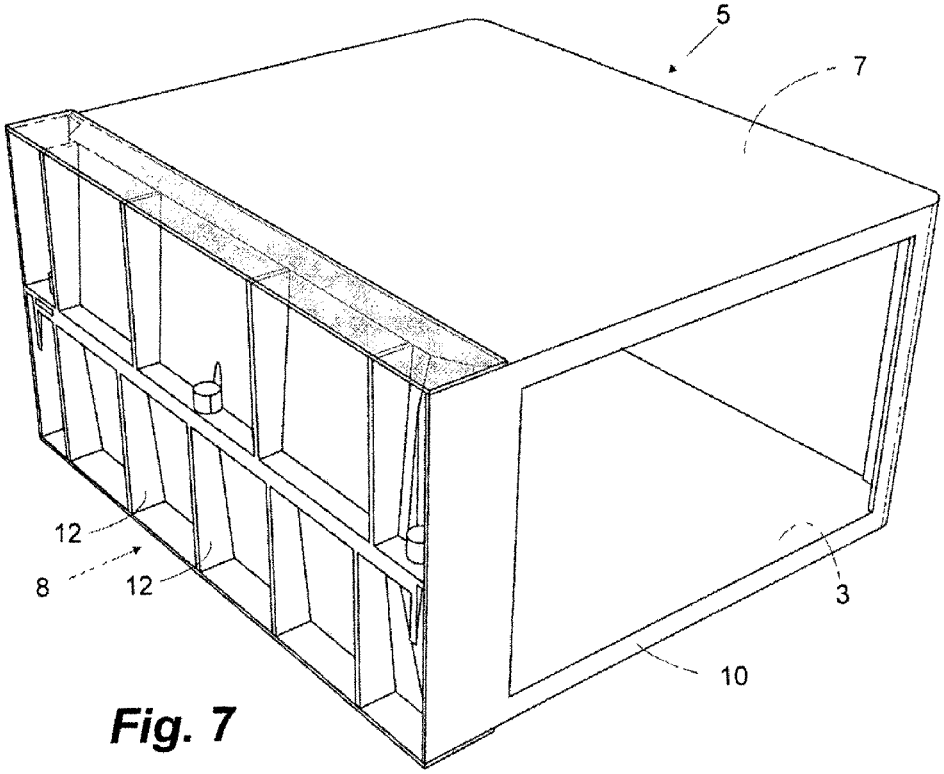
FIG. 7 illustrates a partial perspective view of a cabinet of an air-conditioning apparatus according to a fifth particular embodiment of the present invention.

The characteristics mentioned above of the fourth particular embodiment of the invention are also observed in the fifth particular embodiment of the invention, illustrated in FIGS. 5 to 7. However, in the fifth particular embodiment, the intermediary compartment 8 of the cabinet 5 additionally comprises fins 12, which extend perpendicularly from at least one support 9. Said fins 12 have the function of promoting greater structural rigidity in the vacuum chamber 4.

Regarding the material, the vacuum chamber 4 can be made of one or more types of polymers. Alternatively, other types of materials may be used that are suitable in accordance with the desired application.

Although the description of the particular embodiments above draws references to commercial or residential applications, the air-conditioning apparatus of the present invention can be used for other types of applications and may present modifications in their form of implementation, such that the scope of protection of the invention is limited solely by the content of the accompanying claims, possible equivalent variations being included therein.

The invention claimed is:

1. An air-conditioning apparatus comprising:

a first portion comprising at least an evaporator;

a second portion comprising at least a condenser and a compressor operatively associated to said evaporator; and an intermediary compartment disposed between the first portion and the second portion;

the apparatus being characterized by further comprising a plurality of separate vacuum chambers in the intermediary compartment and a communication tube configured for allowing withdrawal of matter from inside several of the plurality of vacuum chambers via the communication tube, wherein a gap separates at least one of the plurality of chambers from another of the plurality of chambers.

2. The apparatus, as claimed in claim 1, characterized by further comprising a cabinet which externally envelops the first portion and the second portion, the cabinet having a total cross-section area equivalent to the combined total cross-section area of the plurality of vacuum chambers and the gap.

3. The apparatus, as claimed in claim 2, characterized in that the cabinet further comprises:

a first encasement which comprises the first portion; and a second encasement which comprises the second portion, the second encasement being connected to the first encasement;

wherein the intermediary compartment is disposed between the first encasement and the second encasement.

4. The apparatus, as claimed in claim 2, characterized in that the intermediary compartment of the cabinet comprises supports configured for sustaining the plurality of vacuum chambers, the supports being positioned perpendicularly at a base of the cabinet.

5. The apparatus, as claimed in claim 4, characterized in that the intermediary compartment of the cabinet comprises fins which extend perpendicularly from at least one support.

6. The apparatus, as claimed in claim 2, characterized in that the cabinet has the shape of a box.

7. The apparatus, as claimed in claim 1, characterized in that the first portion and/or a second portion comprises at least a ventilator/blower.

8. The apparatus, as claimed in one of claim 1, characterized in that the first portion is disposed internally to a wall or window where the apparatus is installed, a second portion being disposed externally to said wall or window.

9. The apparatus, as claimed in claim 1, characterized in that at least one chamber is made of polymer material.

10. The apparatus, as claimed in claim 1, characterized by being an air-conditioning apparatus of the window type.

11. The apparatus, as claimed in claim 1, characterized in that the apparatus further comprises at least a second communication tube capable of allowing withdrawal of matter from inside several of the plurality of chambers.

* * * * *